US007143723B2

(12) United States Patent
McLachlan

(10) Patent No.: US 7,143,723 B2
(45) Date of Patent: Dec. 5, 2006

(54) PISTON FOR AN INTERNAL COMBUSTION ENGINE

(75) Inventor: Paul Anthony McLachlan, Christchurch (NZ)

(73) Assignee: Pivotal Engineering Limited, Christchurch (NZ)

( * ) Notice: Subject to any disclaimer, the term of this patent is extended or adjusted under 35 U.S.C. 154(b) by 0 days.

(21) Appl. No.: 11/434,614

(22) Filed: May 16, 2006

(65) Prior Publication Data

US 2006/0201452 A1 Sep. 14, 2006

Related U.S. Application Data

(62) Division of application No. 10/239,462, filed as application No. PCT/NZ01/00045 on Mar. 23, 2001, now abandoned.

(51) Int. Cl.
*F02B 33/22* (2006.01)

(52) U.S. Cl. ..... 123/18 R; 123/193.6

(58) Field of Classification Search ..... 123/18 R, 123/18 A, 45 R, 193.6; 92/120, 121
See application file for complete search history.

(56) References Cited

U.S. PATENT DOCUMENTS

| | | | | |
|---|---|---|---|---|
| 4,138,984 A | | 2/1979 | Steidle et al. | |
| 4,599,976 A | | 7/1986 | Meuret | |
| 4,823,743 A | | 4/1989 | Ansdale | |
| 4,825,754 A | | 5/1989 | Devand et al. | |
| 5,222,463 A | * | 6/1993 | Farrell | 123/18 A |
| 5,595,145 A | | 1/1997 | Ozawa | |
| 5,666,912 A | | 9/1997 | McLachlan | |
| 5,699,757 A | * | 12/1997 | Wollny et al. | 123/18 R |
| 5,845,611 A | | 12/1998 | Schmidt et al. | |
| 5,890,416 A | | 4/1999 | Thieme et al. | |
| 5,983,782 A | | 11/1999 | Lebrun et al. | |

FOREIGN PATENT DOCUMENTS

| | | |
|---|---|---|
| DE | 2431662 | 1/1976 |
| GB | 2337087 | 11/1999 |

* cited by examiner

*Primary Examiner*—Marguerite McMahon
(74) *Attorney, Agent, or Firm*—D. Peter Hochberg; Sean Mellino

(57) ABSTRACT

A pivoted piston for an internal combustion engine. The piston has a pivot pin and an arcuate first sealing surface (12) which describes a circumferential path about the pivot pin which forms a removable and replaceable skirt to the piston. The piston also includes a second arcuate sealing surface which also describes a circumferential path about the pivot pin and which is connected to the first arcuate sealing surface (12) by a piston floor (21). The second arcuate sealing surface is composed of at least two arcuate sealing components (24) which are located on a bed (20) with the components (24) being located on the bed (20) so they will have limited transverse movement on the bed (20). The components (24) have mating faces which restrict the path of combustion gases between the mating faces. The piston further includes side seals which are located in grooves (63) in the side of the piston. A restraining pin (60) assists in locating the seals in the seal grooves (63) and also closes a pressure escape path for the combustion gases. The piston further includes means to allow liquid coolant to pass through the pivot shaft, through liquid cooling galleries in the piston and out of the pivot shaft.

6 Claims, 8 Drawing Sheets

PISTON FOR AN INTERNAL COMBUSTION ENGINE

CROSS-REFERENCE TO RELATED APPLICATION

This application is a divisional of U.S. patent application Ser. No. 10/239,462 filed Sep. 23, 2002 now abandoned, which is a U.S. national phase of PCT/NZ01/00045 filed Mar. 23, 2001, and claims priority from New Zealand application Serial No. 338015 filed Mar. 23, 2000.

BACKGROUND TO THE INVENTION

In European Patent Specification WO 95/08055 the disclosure of which is herein incorporated by reference, there is described an internal combustion engine which utilizes a pivoted piston which rocks about a pivot point within a combustion chamber. The piston is connected adjacent the end of the piston remote from the pivot point to a connecting rod which drives a crankshaft. The piston has a first arcuate sealing surface to seal against a wall of the combustion chamber and a second sealing surface which is connected by a piston floor to the first arcuate sealing surface. Both sealing surfaces have a constant radial dimension from the pivot point of the piston.

The first arcuate sealing surface forms a skirt so a portion of the wall of the arcuate sealing surface will make a gas seal with the wall of the combustion chamber. The skirt also assists in dissipating heat in the piston. Adequate clearance between the outer surface of the piston and the chamber wall must be maintained to compensate for distortion that may occur through thermal expansion.

The piston also includes means to seal the sides of the piston against the combustion chamber walls and for this various forms of seals can be utilized. These are normally held in place either on the piston or in the wall of the combustion chamber by seal grooves into which the seal is located. Means are also provided to ensure the seals are correctly located in the grooves.

The prior art piston is generally manufactured in one piece and includes sealing grooves in the leading edge of the piston and in the sides of the piston and means are disclosed in WO95/08055 to enable adequate sealing of the piston against the walls of the combustion chamber to be obtained.

OBJECT OF THE INVENTION

It is an object of this invention to provide an improved piston and/or piston components for utilization in a pivoted piston internal engine such as that described in WO95/08055 which employs a pivoted piston.

DISCLOSURE OF THE INVENTION

Accordingly one form of the invention may be said to comprise a pivoted piston for an internal combustion engine, said piston having a pivot axis by which the piston may be pivoted within a combustion chamber of the internal combustion engine and having a first arcuate sealing surface spaced from the pivot axis and transcribing a circumferential path about the pivot axis, and a second arcuate sealing surface radially offset from the first arcuate sealing surface and connected to the first arcuate sealing surface by a piston floor wherein the second arcuate sealing surface includes at least two components each of which is located contiguously on a seal bed which forms part of the piston with an edge of one component mating with an edge of the second component and wherein means are provided to form a gas seal between said mating edges of the components.

Preferably the second arcuate sealing surface includes at least two substantially rectangular components having longitudinal ends and transverse edges with each component having an arcuate sealing surface adapted to seal against a wall of a chamber and having a rear surface adapted to be supported on the seal bed of the piston, each component being located on the seal bed in a manner that an inner transverse edge of one component will be contiguous to and mate with the transverse edge of the second component and wherein each component will have limited movement on the seal bed to enable the outer transverse edge of each component to maintain sealing contact with walls of the chamber.

Preferably the longitudinal ends of the components are adapted to be located on the grooves formed in the seal bed of the piston.

Preferably the components are spring urged outwardly.

Preferably the contiguous edges of the components will mate together to form a gas seal in conjunction with the seal bed.

Preferably the contiguous edges of the components are formed into an intermeshing shape.

In another form the invention may be said to comprise a pivoted piston for an internal combustion engine, said piston having a pivot axis by which the piston may be pivoted within a combustion chamber of the internal combustion engine and having a first arcuate sealing surface spaced from the pivot axis and transcribing a circumferential path about the pivot axis, and a second arcuate sealing surface radially offset from the first arcuate sealing surface and connected to the first arcuate sealing surface by a piston floor wherein the first arcuate sealing surface comprises a removable skirt located at the edge of the piston remote from the pivot axis.

Preferably the skirt has an outer face which describes a circumferential path from the pivot axis of the piston.

Preferably the skirt is essentially rectangular in shape and has two longitudinal edges and two side edges and wherein the longitudinal edges formed in a manner that the skirt can be located on the piston in a manner that the outer ice of the skirt can seal against a wall of a combustion chamber of the engine.

Preferably one longitudinal edge comprises a tongue adapted to be located in a groove formed in the piston.

Preferably the second longitudinal edge of the skirt comprises a roll formation having a flange by which the roll formation can be anchored to the piston.

In yet another form the invention may be said to comprise a pivoted piston for an internal combustion engine, said piston having a first arcuate seal and a second arcuate seal with both seals transcribing a circumferential path about the pivot axis of the piston, the said first arcuate seal being radially offset from the second arcuate seal, said piston having a floor extending between the first and second arcuate seals, wherein the piston includes side seals located in sealing grooves in the side of the piston, said side seals being adapted to maintain a gas seal between the sides of the piston and the walls of the combustion chamber and wherein each side seal is located within the sealing groove by a locating pin.

Preferably the locating pin is maintained within holes formed in the walls of the sealing groove and engages with a complementary cut out formed in the side seal.

In yet another form the invention comprises a pivoted piston for an internal combustion engine, said piston having a first arcuate seal and a second arcuate seal with both seals transcribing a circumferential path about the pivot axis of the piston, the said first arcuate seal being radially offset from the second arcuate seal, said piston having a floor extending between the first and second arcuate seals, wherein a coolant path for cooling medium is formed within the piston.

Preferably the coolant path includes an entrance from the pivot pin, through galleries formed in the piston and an exit from the pivot pin.

BRIEF DESCRIPTION OF THE DRAWINGS

The invention will now be described with the aid of the accompanying drawings wherein.

DESCRIPTION OF THE PREFERRED EMBODIMENTS

Figure 1:
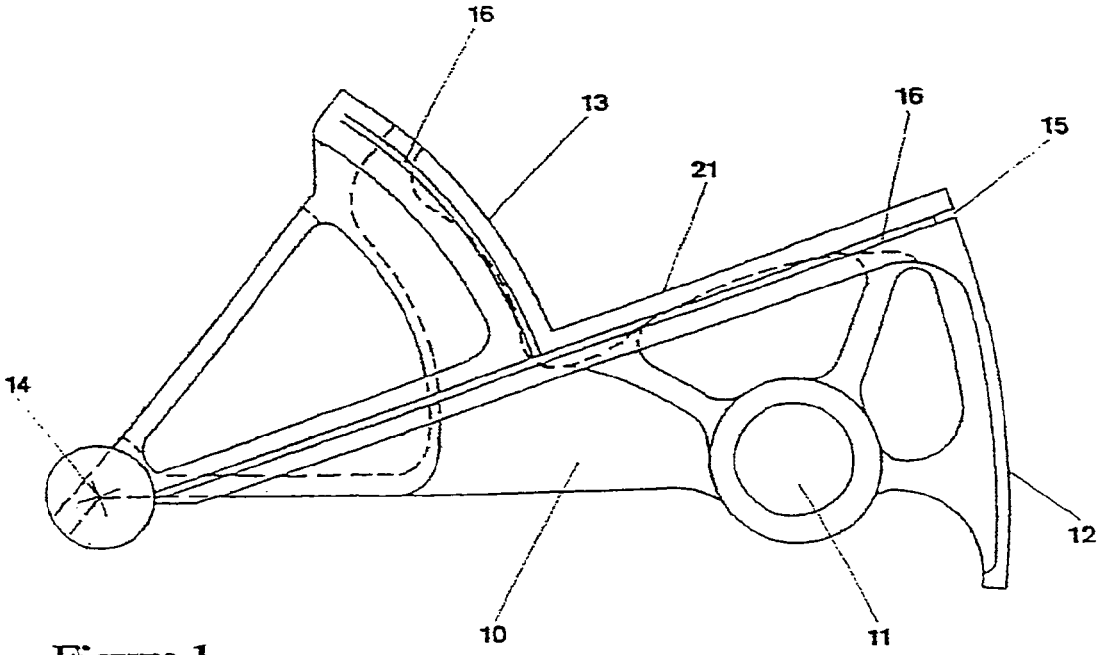
FIG. 1 is a partly diagrammatic side elevational view of a pivoted piston according to the disclosure in WO 95/08055.
Figure 2:
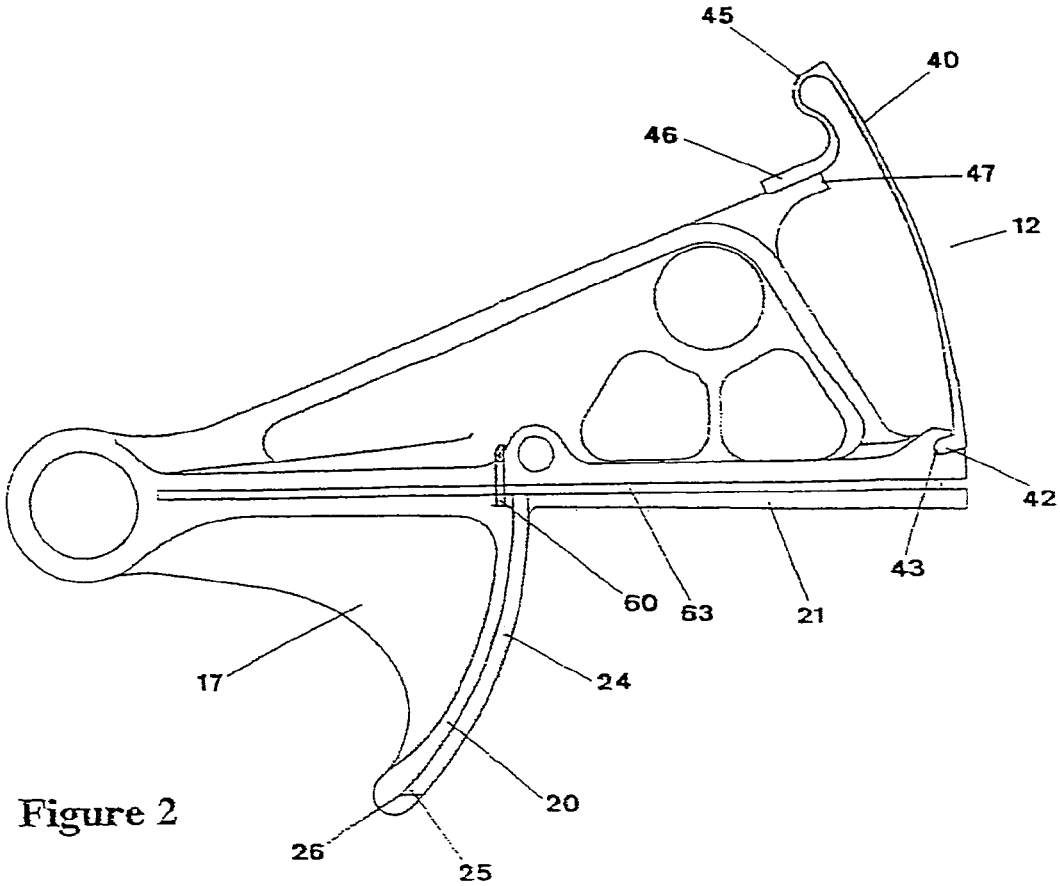
FIG. 2 is a side elevational view of a piston similar to that depicted in FIG. 1 but incorporating some of the integers of the present invention.
Figure 3:
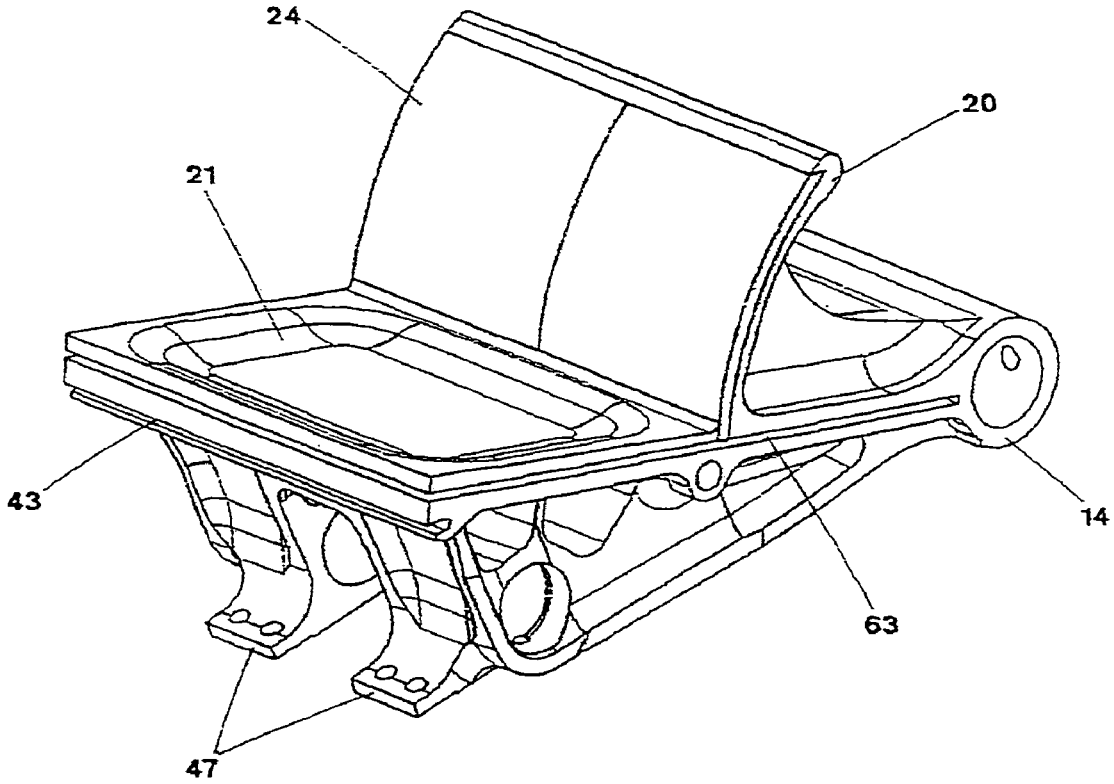
FIG. 3 is a three quarter view from the swept end illustrating the piston of FIG. 2 with a sliding seal but without a skirt.
Figure 4:
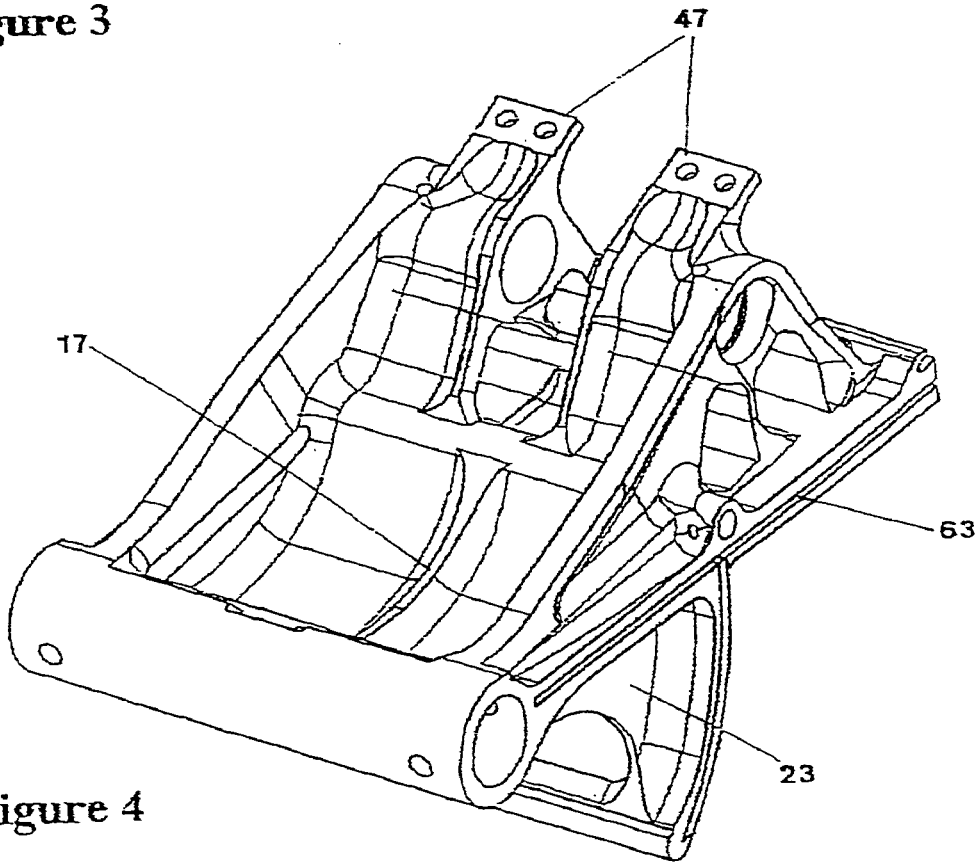
FIG. 4 is a three quarter view from below of the pivot end of the piston illustrated in FIG. 3.
Figure 5:
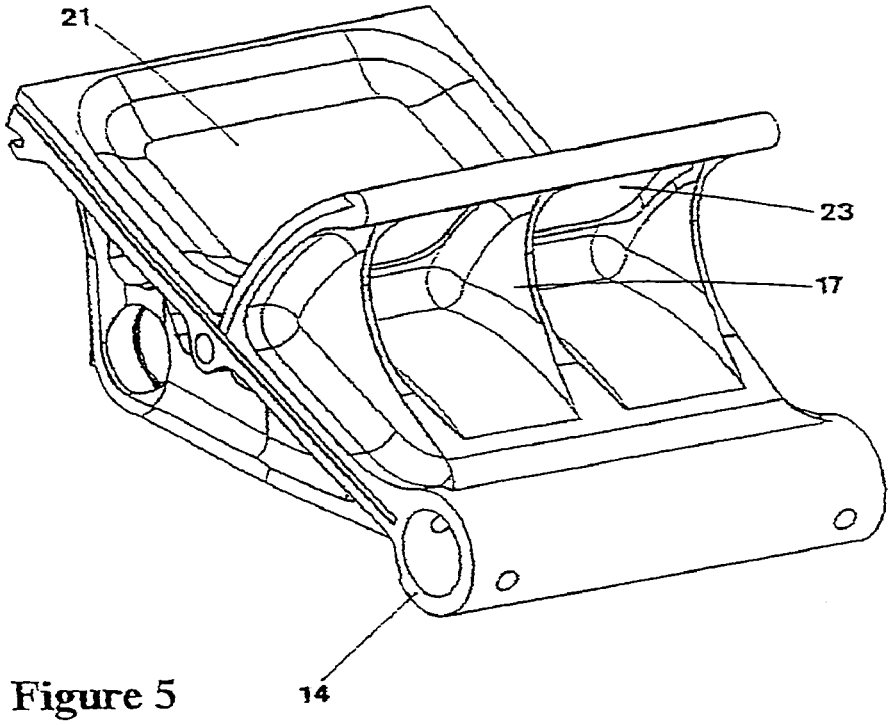
FIG. 5 is a three quarter view from above of the pivot end of the piston illustrated in FIG. 3.
Figure 6:
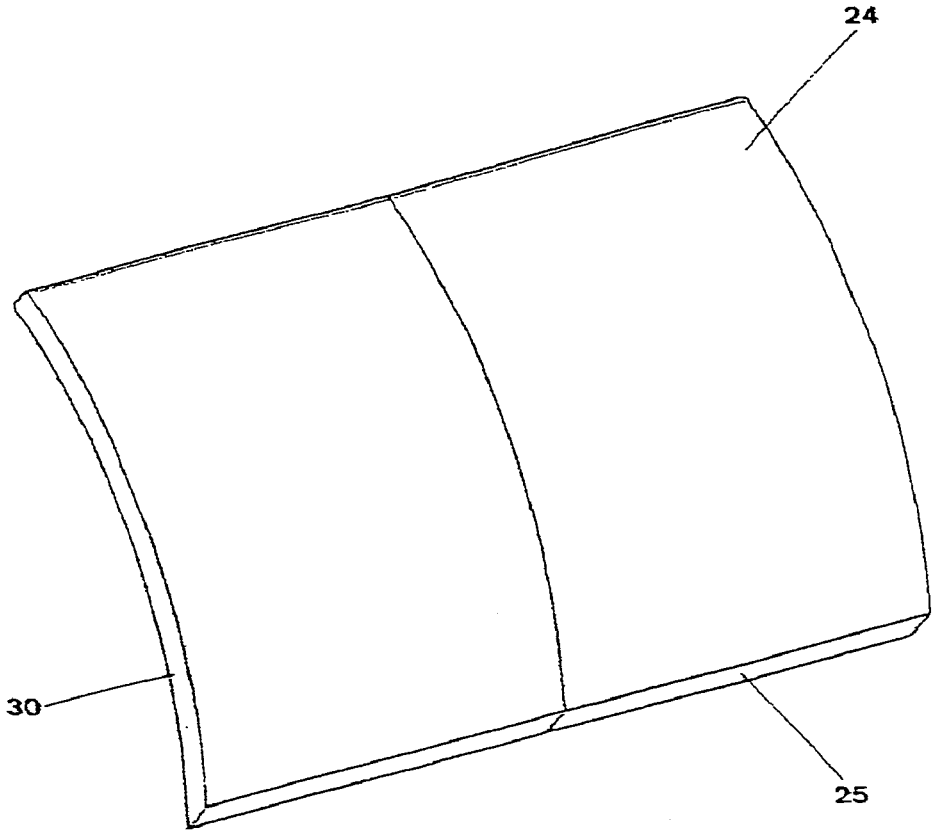
FIG. 6 is a view from the front of one form of the sliding seal incorporated in the piston of the present invention.

The prior art piston 10 disclosed in WO 95/08055 and illustrated in FIG. 1 is pivoted within a combustion chamber (not shown in the drawings) by a pivot pin 14 and has an arcuate first sealing surface 12 which forms a skirt to the piston. The prior art piston also includes a second arcuate sealing surface 13 which is radially offset from the skirt 12 with both the surface of the skirt and the second arcuate sealing surface describing a circumferential path about the pivot pin 14. The piston includes a piston pin 11 to receive an end of a connecting rod (not shown in the drawing), by which the crankshaft of the engine is rotated. The piston illustrated in FIG. 1 also includes a sealing groove 15 incorporated in the arcuate surface 12 to receive a sealing means to allow the arcuate surface 12 to be gas sealed to a wall of a combustion chamber (not shown in the drawings). The second arcuate sealing surface 13 will also form a gas seal against a corresponding wall of a second chamber also not shown in the drawings. The piston includes side grooves 16 to receive seals which will seal against the sides of the combustion chamber.

The improved piston, particularly as illustrated in FIGS. 2 through 8 provides an improved seal design which will aid combustion gas tightness as well as simplifying the manufacturing process. The prior art piston as illustrated particularly in FIG. 1 was generally manufactured in one piece with side seals located at each side of the piston and a seal at the leading edge of the first arcuate surface. These seals were retained in a seal slot 15 (see FIG. 1) which was set back from the piston inner radial surface 13 and in seal slots 16 at the sides of the piston. This sealing design requires the seal slot 15 to extend beyond the side surfaces of the head into the side of the piston to accommodate the seals which are located in the head and extend around the outer edge of the inner radial piston surface to meet with the side seals.

The above form of sealing of the piston against the combustion chamber wall presents various manufacturing problems and to overcome the requirement for the seal slot 15 to extend beyond the side of the piston component and into the side inner plate surface it is necessary to seal the chamber at the corner formed by the intersection of the piston radial surface and the side surface.

Figure 10:
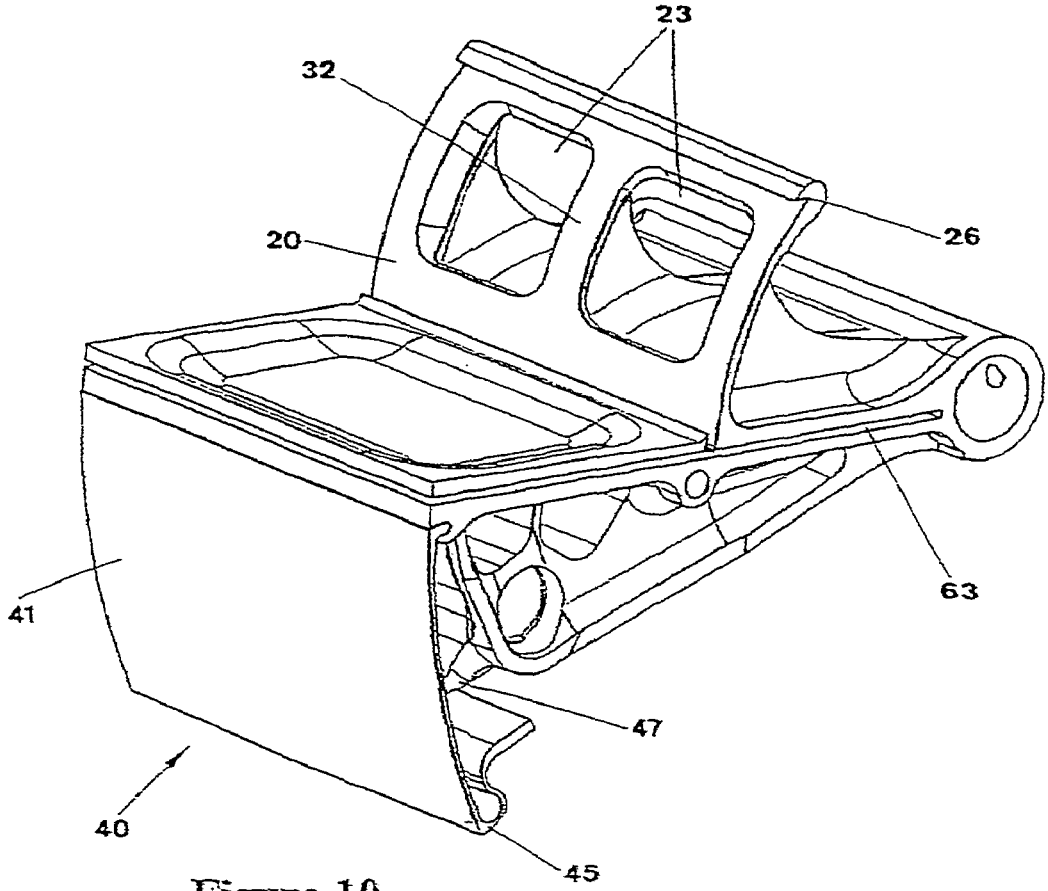
FIG. 10 is a three quarter view from the swept end of a piston of the present invention with a skirt but without the sliding seal.
Figure 11:
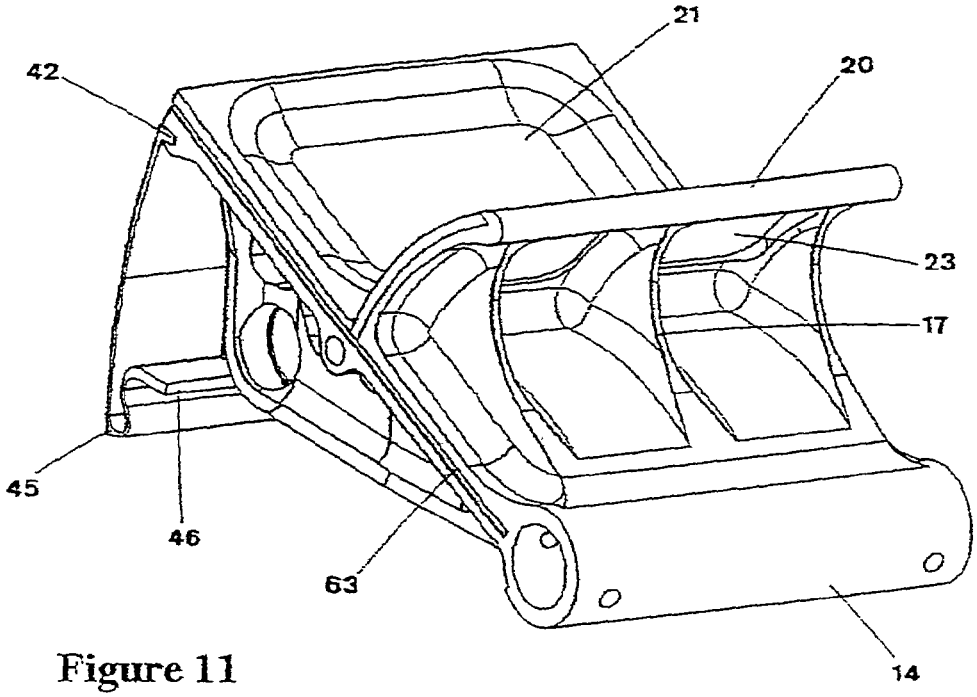
FIG. 11 is a three quarter view from above of the piston illustrated in FIG. 10 viewed from the pivot end of the piston.
Figure 12:
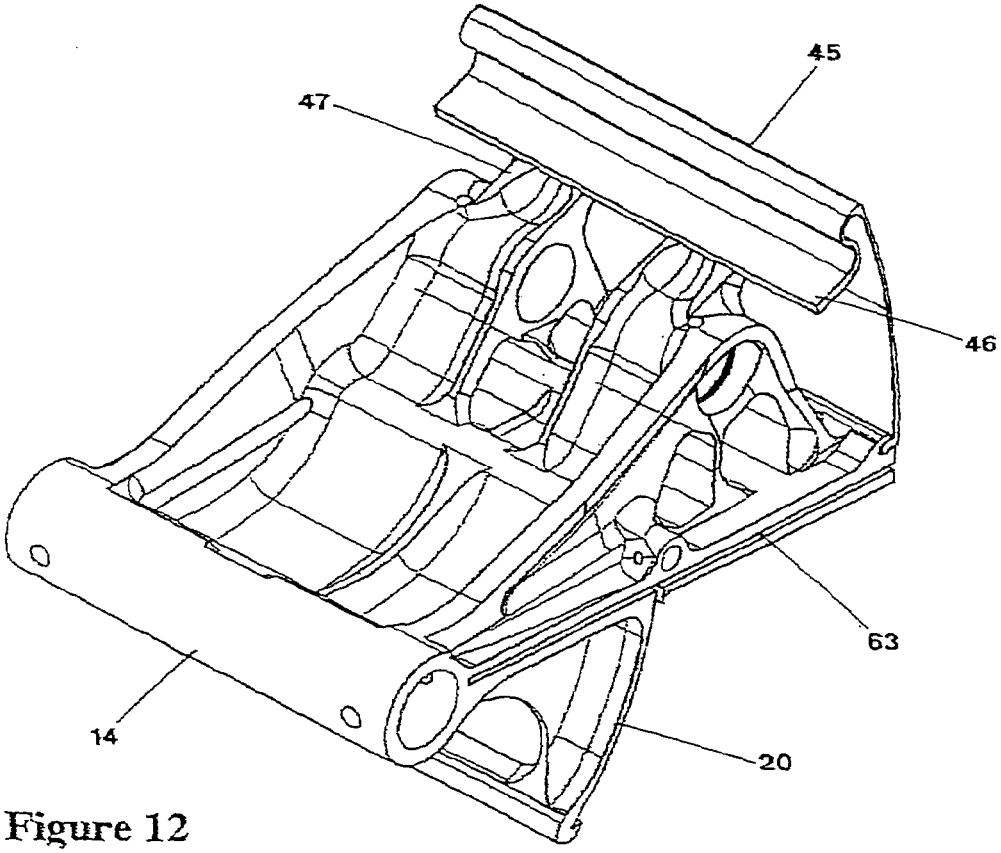
FIG. 12 is a three quarter view from below of the piston illustrated in FIG. 10.
Figure 13A:
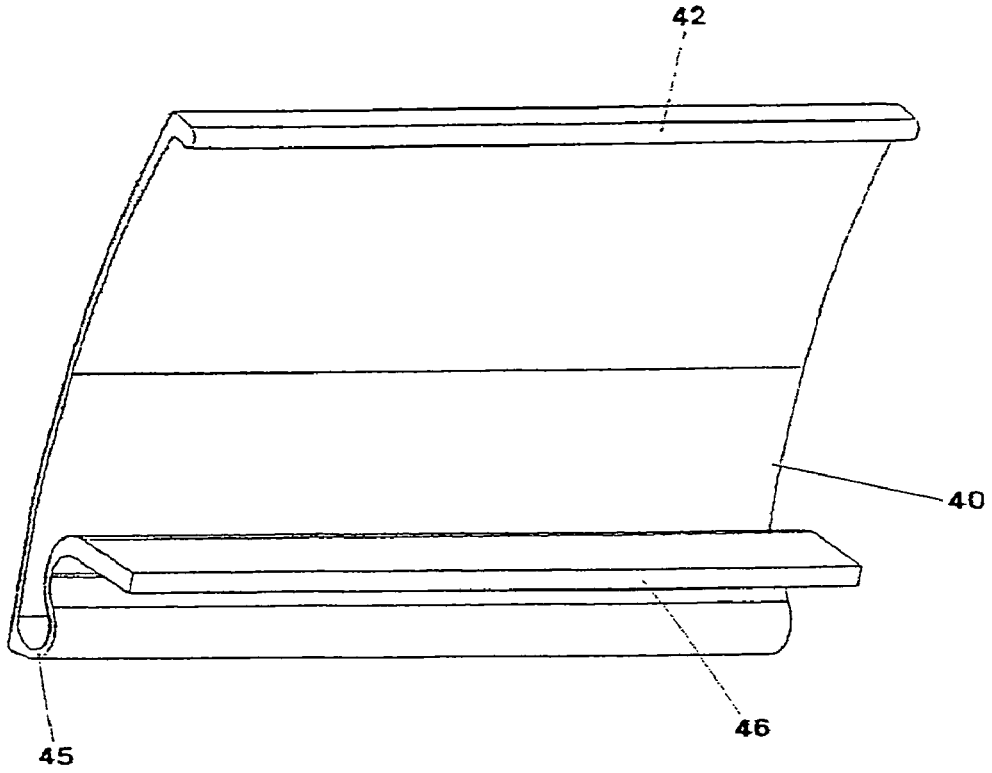
FIG. 13*a* is a three quarter view from the rear of one form of the skirt of the present invention.
Figure 13B:
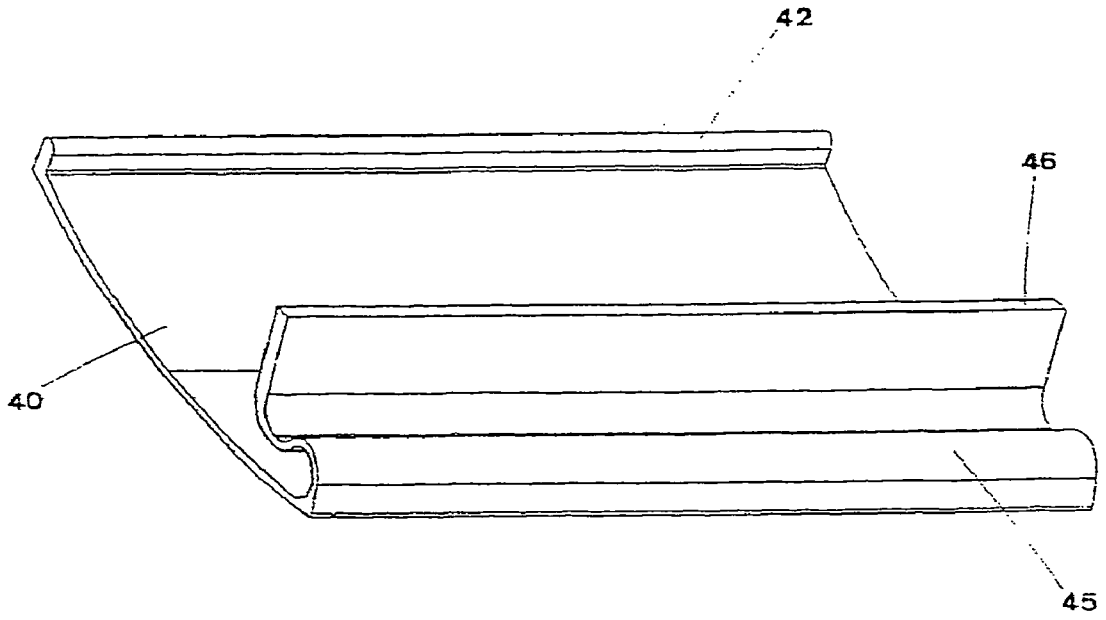
FIG. 13*b* is a three quarter view from the below of the skirt illustrated in FIG. 13*a*.
Figure 13C:
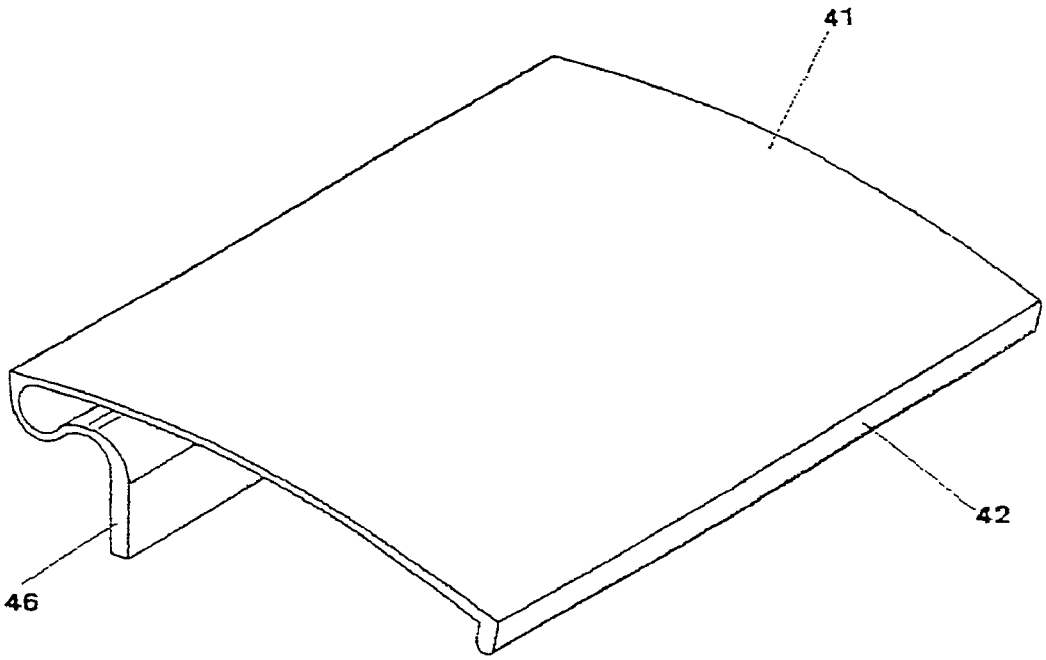
FIG. 13*c* is a three quarter view from the front of the skirt illustrated in FIG. 13*a*.

As illustrated in FIGS. 2 through 9, the construction of the sealing surface 13 of FIG. 1 has been modified. The seal is now composed of a sliding surface—see particularly FIGS. 3, 6, 7 and 8. The sealing surface comprises a bed 20 which extends from the floor 21 of the piston in a direction radial to the pivot axis 14. The bed is suitably reinforced by gussets 17 (see FIG. 4) to provide adequate rigidity to the structure. Preferably the bed 20 includes cut outs 23 (see FIGS. 9 and 10) separated by a bridge 32.

In the version illustrated the sliding seals (see particularly FIGS. 7 and 8) comprise two arcuate sealing components 24 which may be substantially similar. The components include tongues 25 which can locate in grooves 26 formed in the bed 20 of the sealing surface. The rear surface of the components 24 is shaped to engage closely over the bed 20 and the tongues 25 will locate in the grooves 26 in a manner that the components will be retained in the grooves 26 but can have limited transverse movement within the grooves 26.

Figure 7:
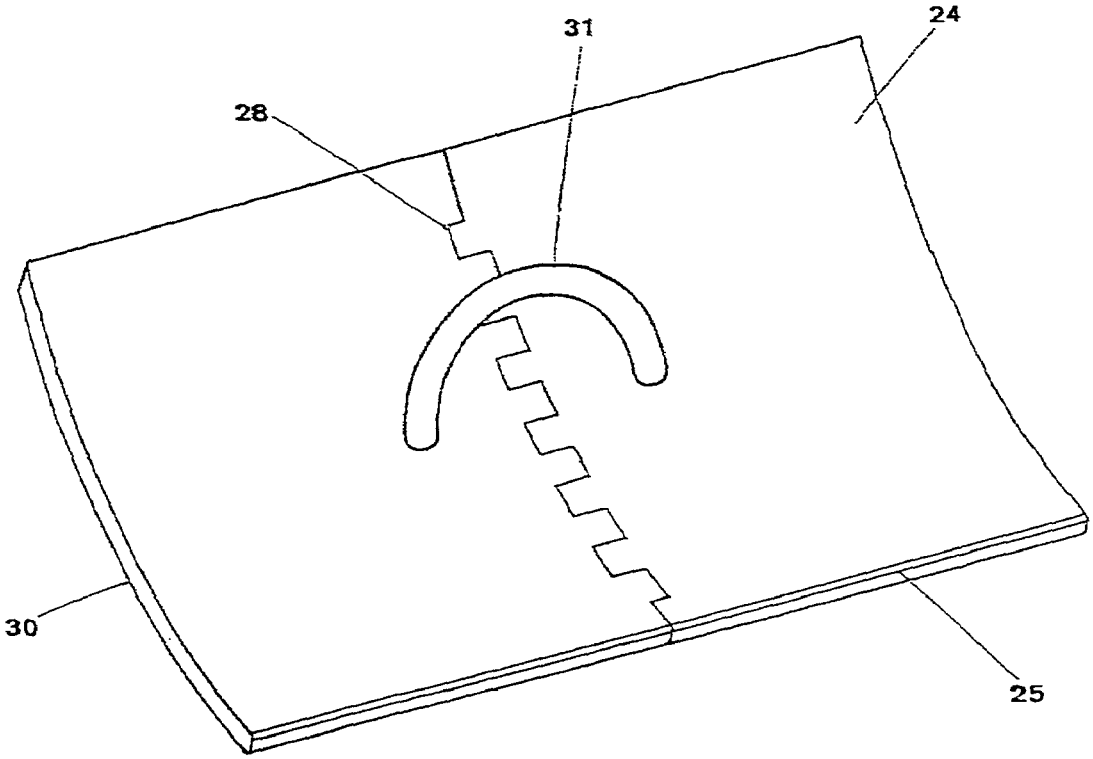
FIG. 7 is a view of the rear of the sliding seal of FIG. 6 and also illustrating one form of modification to the joint between the contiguous components of the sliding seal and further illustrating a preloading spring.
Figure 8:
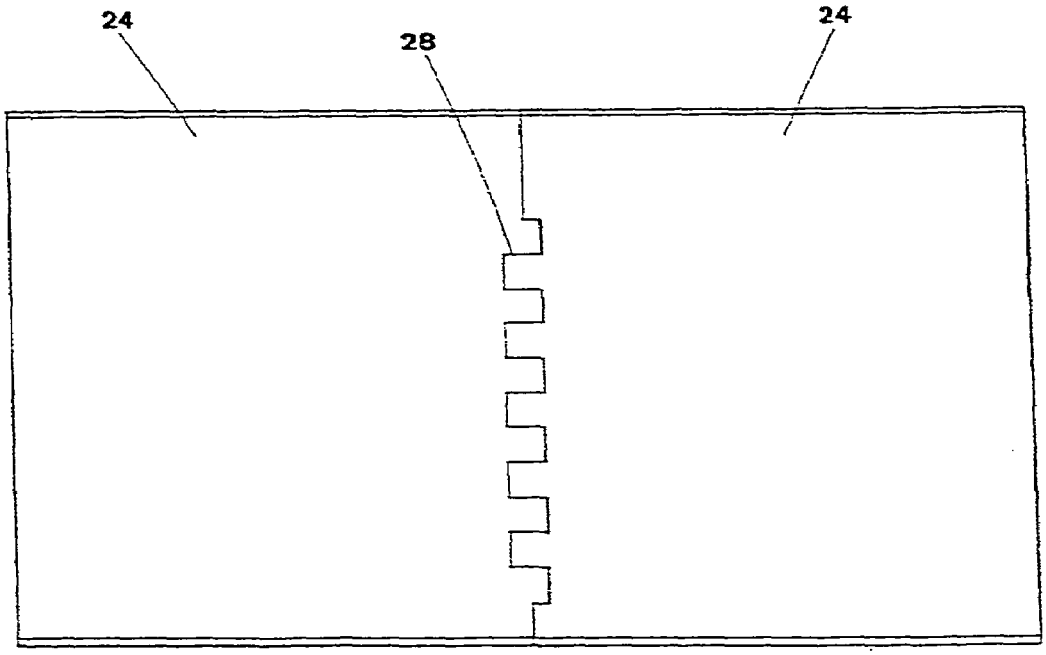
FIG. 8 is a view of the front of the sliding seal illustrated in FIG. 7.
Figure 9:
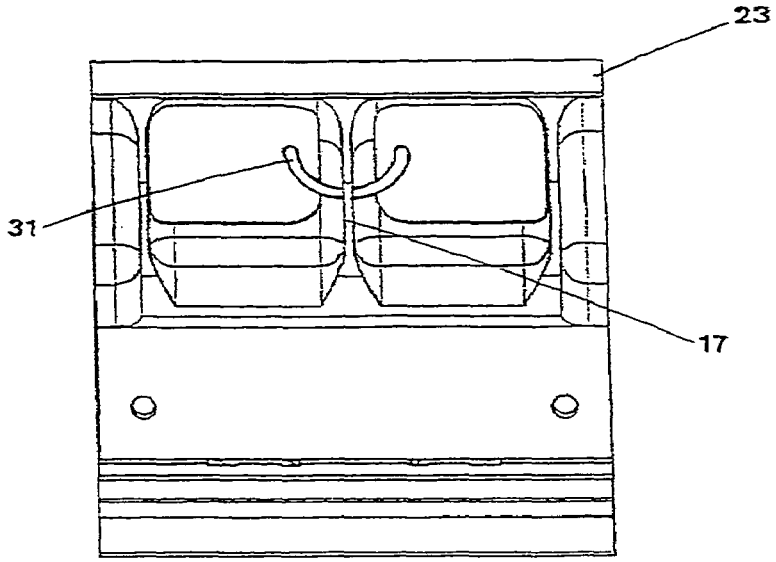
FIG. 9 is a view from the pivot end of the piston according to the present invention illustrating the location of the sliding seal and of the preloading spring incorporated with the piston.

Each arcuate sealing component has a mating face which is preferably formed of a meshing surface such as that illustrated at 28 in FIGS. 7 and 8. One preferred form of meshing surface which is illustrated is in the shape of an interlocking sine wave. The purpose of the meshing surface is to allow the two sealing components to have independent transverse movement on the seal bed 20 but place a restriction in the path of combustion gases through the mating faces at the junction of the two components. It will be understood that other shapes of meshing surface can also be employed and the particular configuration illustrated is provided only as an example of one form of a meshing surface.

The seal components 24 are formed of a highly wear resistant material or have highly wear resistant surfaces and in particular the side edges 30 of the seal components are formed to provide a sealing surface against the sides of the combustion chamber. To ensure an adequate seal, the components are preferably spring loaded to urge the edges 30 of the components 24 against the wall of the combustion chamber. One preferred form of attaining this object is by way of a tension spring 31—see particularly FIGS. 7 and 9. The spring 31 is formed of spring steel in an essentially U shape and is located in a hole formed in the gusset 15 behind the bridge 32 of the piston. Various methods of anchoring the legs of the spring to the seal components can be utilized. One highly preferred form is to engage the ends of the legs of the spring in holes formed in the rear surface of the seal components 24 as illustrated in the drawings.

It will be understood that while the sliding seal is illustrated as being composed of two components, this is a preferred configuration only and more than two components can be utilized as required with appropriate sealing surfaces 28 between each component. The break line between the two components is formed into interlocking surfaces to ensure thermal expansion of the component parts will not result in an excessive gap at the break line where pressure leakage could otherwise occur. It is to be understood that the form of the interlocking surface is a preferred form only and various configurations that will attain the desired object of providing a gas seal through the joint are contemplated as will be apparent to those skilled in this art.

The purpose of the tension spring 30 is to preload the components of the sliding seal outwardly to thereby assist in maintaining a sealing contact between the sides of the seal components against the sides of the combustion chamber.

A further advantage arising through the use of the sliding seal components is that the sealing surface 13 is now composed of components which are separate from the piston component and can therefore be manufactured separately from the piston. The components are restrained from moving under centrifugal force by the use of the retaining grooves 26 in the bed 20 of the piston. Should wear occur on the faces of the sliding seal components, then it will be a simple matter to remove and replace the components.

A further benefit resulting from the modification is that the same seal component will mate with both the seal located in the head and the side wall plate inner surface. The chamber sealing line around the piston intersects at a point where the inner radial sealing surface meets the side wall of the chamber. A seal housing is therefore not required in the inner surface of the chamber side wall plate because the sealing of the piston at the two sides of the inner radial piston surface is not set back from the inner radial piston surface.

A yet further benefit is that the arced surface of the sealing means is not distorted from thermal expansion because it is not an integral part of the piston and can therefore expand uniformly. This ensures that a good straight sealing surface is retained upon which the seal can maintain good sealing contact with the wall of the chamber.

A still further benefit is that the sliding seal components are replaceable components. This facilitates the manufacture of the piston since it will overcome difficulties in grinding the piston inner arced surface because this component can be surface ground on a rotating mandrel.

The improvement also includes a modified skirt for the piston, a preferred embodiment of which is illustrated in FIGS. 10 through 13.

The skirt 40 is shaped so when it is attached to the piston, it will have an outer surface 41 which describes a circumferential path from the pivot axis 14. The skirt (see more particularly FIGS. 13*a*, 13*b* and 13*c*) is essentially rectangular in shape and at one transverse edge is formed into a tongue 42 which will be a neat fit in the locating groove 43 (see FIG. 3) formed in the front wall of the piston below the floor 21 of the piston. The second transverse edge of the skirt is preferably shaped into a roll formation 45 to provide a flange 46 which will bear on lugs 47 (see also FIGS. 3 and 4) of the piston. The flange 46 is attached to the lugs 47 by rivets (not shown in the drawings) to securely locate the lower edge of skirt to the piston. Because of the flexibility of the roll formation 45, the skirt is able to float partly out of the locating groove 43 and this enables good sealing contact to be made with the wall of the combustion chamber. Should the skirt require replacement for any reason, then it is a simple matter to remove the rivets and lift the tongue 42 out of the locating groove 43.

In the configuration of the engine as disclosed in European Patent Specification WO 95/08055, the main function of the skirt in the piston is to seal off the exhaust port from the primary induction chamber when the piston is at the top dead centre position. A skirt is also effective in transmitting heat away from the piston crown area. While the prime function of the skirt of the known round pistons is to restrain thrust loads, this is not a requirement of the piston disclosed in the European Specification 95/08055 and it is therefore possible to make the skirt as a separate and essentially floating component. The advantage in making the skirt as a separate component as disclosed herein is that it can be made to move outwardly from the piston component to meet with the surface of the combustion chamber and retain a consistent contact irrespective of whether the piston is hot or cold. This will compensate for expansion of the piston and ensure good sealing of the primary induction chamber from the exhaust port. Heat is transferred from the front edge of the piston into the combustion chamber wall through the floating outer radial skirt. This is achieved because the floating skirt will retain a direct contact with both the piston and the cooled surface of the combustion chamber throughout a range of piston thermal expansion. In addition, because the skirt can be a replaceable component, manufacture of the piston is simplified.

While the skirt 40 is descried as having one transverse edge formed into a tongue 42 and the second transverse edge as being shaped into a roll formation 45, it is to be understood these are highly preferred methods of attaching the skirt to the piston. Other methods of attaching the skirt to the piston as will be apparent to those skilled in the art can be utilized, with the main requirement being that the skirt is securely attached to the piston and yet has a desired degree of float in relation to the piston and be readily removable and replaceable is that should be required.

It is also possible to liquid cool the piston by forming a liquid coolant path through the pivot shaft. The coolant can be circulated into the piston by way of the pivot shaft and then pass through piston cooling galleries and be discharged through the other end of the pivot shaft. The liquid cooling has important benefits in the potential to remove heat from the piston at a rate which will enable the engine to be run at high loads for prolonged periods. An ancillary advantage of the potential for liquid cooling is in engines designed for aircraft operation because this will enable a good margin of safety into the safe full load operation time limit. It will also reduce the clearance necessary for thermal expansion when fitting the piston into the engine.

Figure 14:
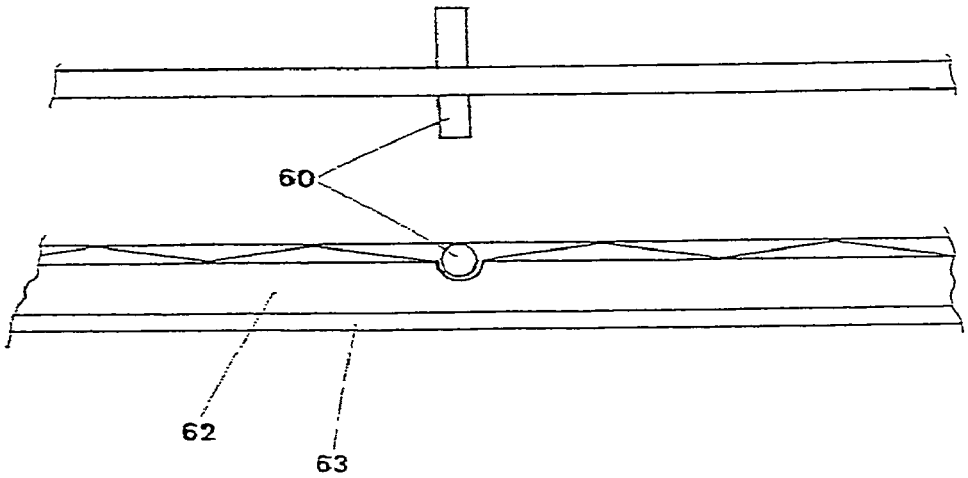
FIG. 14 is a partly diagrammatic view of a detail illustrating a seal locating pin.

A yet further modification of the piston is the location of the side seals in the piston. It is known for instance to use a pin in conventional piston grooves to ensure that the piston ring does not rotate in the groove. This is particularly important when an inlet or exhaust port is formed in the wall of the combustion chamber to prevent the possibility of the piston ring moving in the ring groove to a position where the gap in the piston ring can register with the port in the wall of the combustion chamber. In the case of the present invention as illustrated more particularly in FIGS. 2 and 14 a restraining pin 60 is utilized to restrain the horizontal side seals 62 from moving under the action of centrifugal force created by the arced path of the piston. The restraining pins 60 in the horizontal side seal 62 register with a matching groove 63 formed on the inner edge of the seal to restrain the centrifugal load of the side seal from bearing on the outer ends of the front seal. A further function of the side seal restraining pin 60 is to close the pressure escape path from behind the horizontal side seal. The pin 60 affects this because it is located at the rear of the seal groove 63 on the pivot side of the combustion chamber sealing area. The horizontal side seal 62 therefore fits snugly around the restraining pin 60 so the gas leakage path behind the seal is blocked.

Having read the specification, it will be apparent to those skilled in the art that various modifications and amendments can be made to the construction and yet still come within the general concept of the invention. All such modifications and changes are intended to be included within the scope of this application.

What is claimed is:

1. A pivoted piston for an internal combustion engine, said piston having a pivot axis by which the piston may be pivoted within a combustion chamber of the internal combustion engine and having a first arcuate sealing surface spaced from the pivot axis and transcribing a circumferential path about the pivot axis, and a second arcuate sealing surface radially offset from the first arcuate sealing surface and connected to the first arcuate sealing surface by a piston floor wherein:

said piston has a seal bed; and the second arcuate sealing surface comprises at least two components each located contiguously on the seal bed, said components having mating edges formed by an edge of one component mating with an edge of another component and wherein means form a gas seal between said mating edges of the components.

2. The piston as claimed in claim 1, wherein the second arcuate sealing surface comprises at least two substantially rectangular components having longitudinal ends, an inner transverse edge, an outer transverse edge, an arcuate sealing surface adapted to seal against a wall of a chamber, and a rear surface supported on the seal bed of the piston, each component being located on the seal bed such that the inner transverse edge of one component and the inner transverse edge of the second component mate, and wherein each component will have limited movement on the seal bed enabling the outer transverse edge of each component to maintain sealing contact with walls of the chamber.

3. The piston as claimed in claim 2, wherein:

said seal bed has grooves; and the longitudinal ends of the components are located on the grooves.

4. The piston as claimed in claim 2, wherein the components are spring urged outwardly.

5. The piston as claimed in claim 2, wherein the contiguous edges of the components mate together forming a gas seal in conjunction with the seal bed.

6. The piston as claimed in claim 2, wherein the contiguous edges of the components form an intermeshing shape.

* * * * *

UNITED STATES PATENT AND TRADEMARK OFFICE

CERTIFICATE OF CORRECTION

PATENT NO. : 7,143,723 B2
APPLICATION NO. : 11/434614
DATED : December 5, 2006
INVENTOR(S) : Paul Anthony McLachlan It is certified that error appears in the above-identified patent and that said Letters Patent is hereby corrected as shown below:

On the title page of the patent, after the data entered at item (62) below the heading Related U.S. Application Data, insert the following:

--Foreign Application Priority Data
March 23, 2000 (NZ) 338015--

Signed and Sealed this

Tenth Day of July, 2007

JON W. DUDAS
*Director of the United States Patent and Trademark Office*